US005671557A

United States Patent [19]

Carlson et al.

[11] Patent Number: 5,671,557

[45] Date of Patent: Sep. 30, 1997

[54] NOTICE ASSEMBLY

[75] Inventors: Bruce W. Carlson, Minneapolis; Thomas J. Barnidge, Burnsville; Tanya M. Laine, Inver Grove Heights; Mary K. Miller-Bruns, Eagan; Kenneth J. Kirchhoff, Gem Lake, all of Minn.

[73] Assignee: Minnesota Mining and Manufacturing Company, St. Paul, Minn.

[21] Appl. No.: 145,788

[22] Filed: Oct. 29, 1993

[51] Int. Cl.[6] ..... G09F 11/02

[52] U.S. Cl. ..... 40/358; 40/506

[58] Field of Search ..... 40/114, 120, 358, 40/506; 248/442.2

[56] References Cited

U.S. PATENT DOCUMENTS

| | | | |
|---|---|---|---|
| 1,715,259 | 5/1929 | Vose | 40/506 |
| 2,417,935 | 3/1947 | Kiser . | |
| 3,245,164 | 4/1966 | Arenson | 40/358 X |
| 3,304,916 | 2/1967 | Abernethy | 40/358 |
| 4,021,953 | 5/1977 | Couch | 40/506 X |
| 4,086,715 | 5/1978 | Blonigen | 40/506 X |
| 4,395,056 | 7/1983 | Sferragatta | 40/120 X |
| 4,696,118 | 9/1987 | Cross . | |
| 4,722,145 | 2/1988 | Prest | 40/584 |
| 4,756,104 | 7/1988 | Bailey . | |
| 5,099,594 | 3/1992 | Reas et al. | 40/593 |

FOREIGN PATENT DOCUMENTS 0 333 582 9/1989 European Pat. Off. .

*Primary Examiner*—Brian K. Green
*Attorney, Agent, or Firm*—Gary L. Griswold; Walter N. Kirn; William L. Heubsch

[57] ABSTRACT

A notice assembly comprising a support portion including a base part adapted to be supported on a horizontal surface, a vertical wall part having a lower edge attached to the base part and a hollow tubular part fixed along an upper edge of the wall part with an axially extending through opening in the tubular part facing the same direction as the front surface of the wall part. A display member has a portion rotatably mounted in the tubular part. That portion of the display member has a peripheral surface bearing a plurality of set of graphic symbols providing information about the location of the person (e.g., AT LUNCH, OUT OF OFFICE, RETURN SOON, IN MEETING). By manual rotation of the display member, any of the sets of graphic symbols can be positioned in the opening of the tubular part where they will be observed by a person looking at the notice assembly. Graphic symbols are provided on the front surface of the wall part that provide incomplete information about one or more of a) the location of the person, b) the time of return for the person, c) the normal work hours for the person, and c) an alternate person to contact when the person is absent; together with ink receptive means that afford application of indicia with quick drying ink from a quick drying ink applying implement or pen to complete the information, and afford subsequent removal of the ink.

12 Claims, 3 Drawing Sheets

NOTICE ASSEMBLY

TECHNICAL FIELD

The present invention relates to notice assemblies of the type used at specific locations to notify others of information concerning persons when those persons are absent from the locations.

DISCLOSURE OF INVENTION

Notice assemblies are known that can be used at specific locations, such as a notice assembly in an office area to notify others of information concerning a person when that person is absent from the location. Such notice assemblies have, for example, included sign out boards bearing the names of persons in the general area and some means associated with each name indicating whether that person is in or out of the area, sometimes together with a place on which the present location of a person absent from the area can be written and later erased. Also, persons absent from their normal locations sometimes leave notes indicating their present location and/or when they will return.

DISCLOSURE OF INVENTION

The present invention provides a notice assembly for use at a specific location, such as on the desk of a person, to notify others of information concerning that person when he or she is absent from the location, which notice assembly is much more versatile and easily used than notes or the known types of prior art notice assemblies.

According to the present invention there is provided a notice assembly comprising a support portion including a vertical wall part and a hollow tubular part having an axially extending through viewing opening fixed along an upper edge of the wall part with the opening facing the same direction as the front surface of the wall part. Means (which could include a base part attached to the wall part and adapted to be supported on a horizontal surface or an attachment device for attaching the support portion to a wall) is provided for supporting the support portion with the wall part projecting generally vertically upwardly and the tubular part uppermost. A display member has a portion rotatably mounted in the tubular part. That portion of the display member has a peripheral surface bearing a plurality of axially extending circumferentially spaced sets of graphic symbols providing information about the location of the person (e.g., AT LUNCH, OUT OF OFFICE, RETURN SOON, IN MEETING). By manual rotation of the display member, any one of the sets of graphic symbols can be positioned at the viewing opening of the tubular part so that a person looking at the notice assembly will see those symbols. Also, graphic symbols providing incomplete information about one or more of a) the location of the person, b) the time of return for the person, c) the normal work hours for the person, and c) an alternate person to contact when the person is absent are visible along the front surface of the wall part, and ink receptive means are provided on the front surface of the wall part that afford application of indicia with quick drying ink from a quick drying ink applying implement or pen to complete the information, and subsequent removal of the ink.

The ink receptive means can comprise a polymeric layer defining the front surface of the wall part and affording application of quick drying ink to form indicia completing the information, and subsequent wiping away of the ink from the front surface.

Alternatively, the ink receptive means can comprise a pad of sheets mounted along the front surface, each of which sheets has a layer of pressure sensitive adhesive on its rear surface releasably attaching it to the front surface of the adjacent sheet in the pad, with the uppermost sheet in the pad adapted to be written on with quick drying ink to form indicia completing the information, and that uppermost sheet being removable to remove the ink. When the ink receptive means is provided by a pad of sheets, the incomplete information can be visible along the front surface of the wall part adjacent the pad of sheets. Alternatively, the incomplete information can be printed on each of the sheets forming the pad of sheets.

The display member can include flange portions fixed at ends of the portion mounted for rotation in the tubular part, which flange portions can project radially along axially spaced end surfaces of the tubular part, and can be manually engageable to afford rotation of the display member to display a desired one of the sets of graphic symbols at the viewing opening in the tubular part.

Also, the support portion including its base (if present), vertical wall and hollow tubular parts can comprise a unitary extrusion, and the base part, if present, can include a generally U-shaped channel adapted to receive a pen for applying the quick drying ink.

BRIEF DESCRIPTION OF DRAWING

The present invention will be further described with reference to the accompanying drawing wherein like reference numerals refer to like parts in the several views, and wherein.

DETAILED DESCRIPTION

Figure 1:
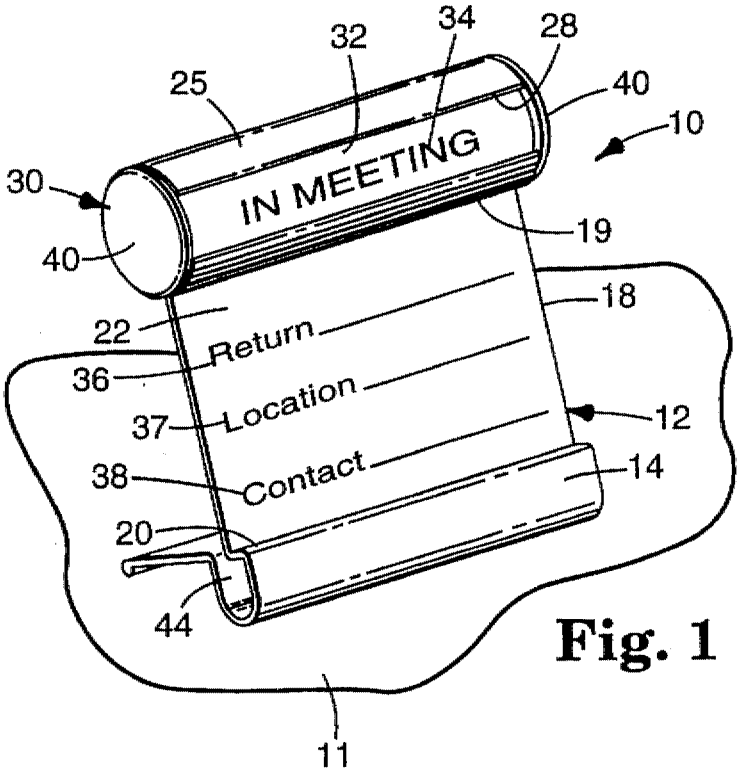
FIG. 1 is a perspective view of a first embodiment of a notice assembly according to the present invention supported on a horizontal surface.
Figure 2:
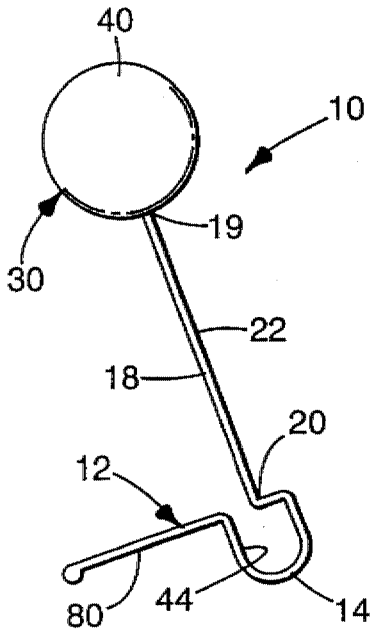
FIG. 2 is an end view of the notice assembly of FIG. 1.

Referring now to FIGS. 1, 2, 3, 4, and 5 of the drawing there is illustrated a notice assembly according to the present invention that is generally designated by the reference numeral 10. The notice assembly 10 is adapted for use at a predetermined location such as on a horizontal surface 11 that may be the top surface of a persons desk to notify others of information concerning the person when he or she is absent from that location.

Figure 3:
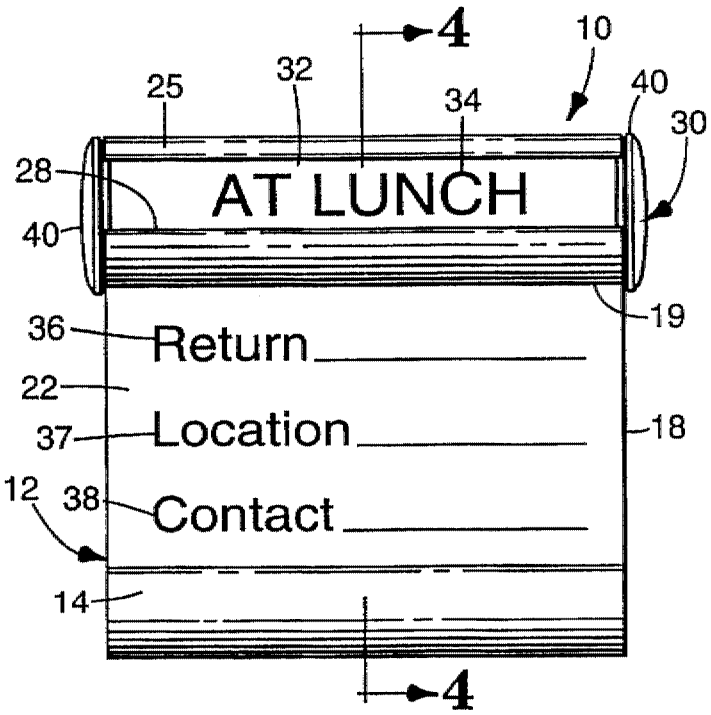
FIG. 3 is a front view of the notice assembly of FIG. 1 displaying a different one of a plurality of sets of graphic symbols providing information about the location of a person that are available on a rotatable display member included in the notice assembly than is displayed in FIG. 1.
Figure 4:
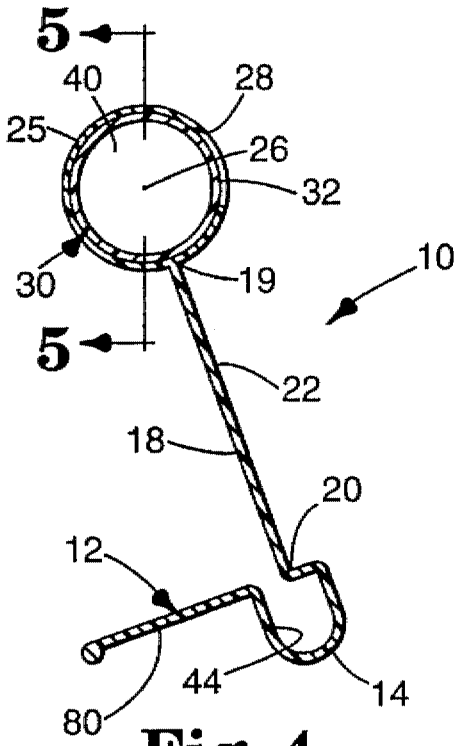
FIG. 4 is a sectional view taken approximately along line 4—4 of FIG. 3.
Figure 6:
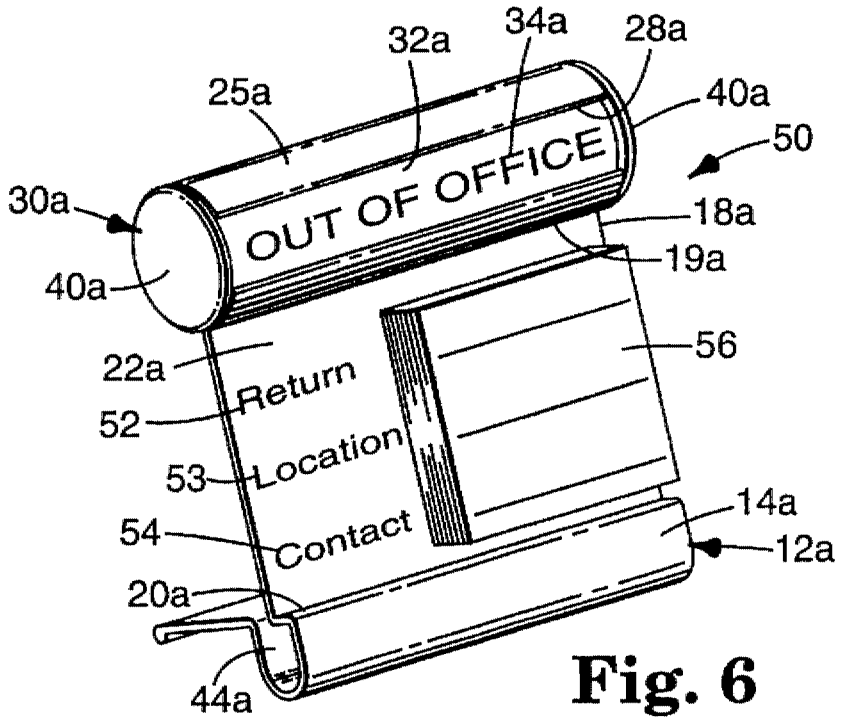
FIG. 6 is a perspective view of a second embodiment of a notice assembly according to the present invention.
Figure 7:
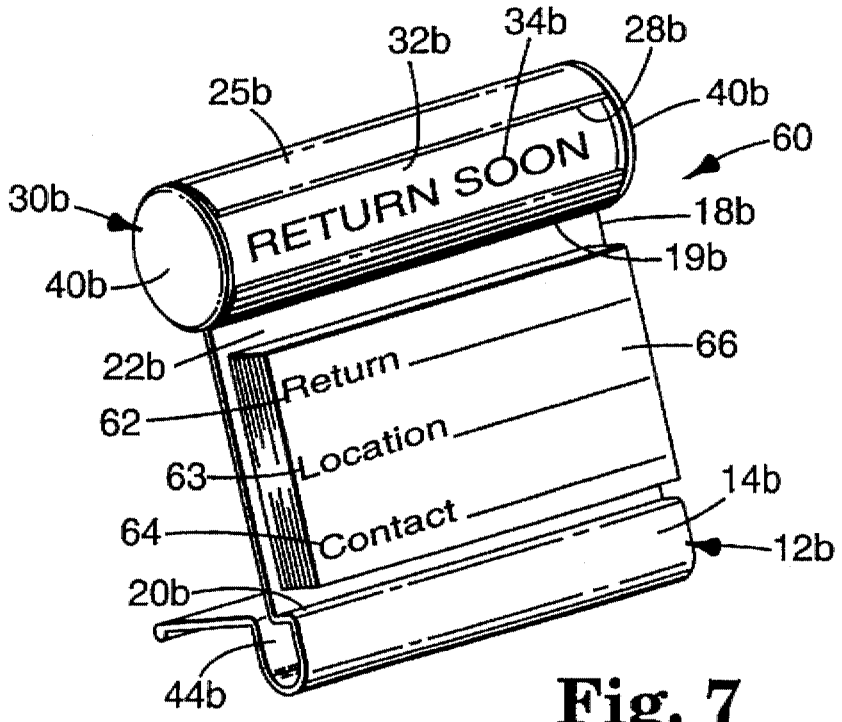
FIG. 7 is a perspective view of a third embodiment of a notice assembly according to the present invention.

Generally, the notice assembly 10 includes a support portion 12 comprising a base part 14 adapted to be supported on a horizontal surface, a vertical wall part 18 having opposite normally upper and lower opposite edges 19 and 20 with the lower edge 20 attached to the base part 14 and having a front surface 22 extending between the base part 14 and the upper edge 19, and a hollow tubular or cylindrical part 25 having an axis 26 (see FIG. 4) and having an axially extending through slot or viewing opening 28. The tubular part 25 is fixed along the upper edge 19 of the vertical wall 18 with its axis 26 parallel to the upper edge 19 and the viewing opening 28 facing the same direction as the front surface 22 of the wall part 18. The base part 14 is adapted to support the wall part 18 and the tubular part 25 on a horizontal surface (such as the surface 11) with the wall part 18 projecting generally vertically upwardly from the horizontal surface and the tubular part 25 uppermost. The notice assembly 10 also includes a display member 30 comprising a cylindrical portion 32 mounted in the tubular part 25 for rotation about its axis 26. The cylindrical periphery of the portion 32 bears a plurality of axially extending circumferentially spaced sets of graphic symbols 34 providing information about the location of the person (e.g., "IN MEETING" as is illustrated in FIG. 1, "AT LUNCH" as is illustrated in FIG. 3, "OUT OF OFFICE" as is illustrated in FIG. 6, or "RETURN SOON" as is illustrated in FIG. 7) and has a portion bearing no such graphic symbols (not shown) that can be paced at the viewing opening 28. By rotating the cylindrical portion 32, any of the sets of graphic symbols 34 is positionable at the viewing opening 28 of the tubular part 25 to afford viewing that set of graphic symbols by a person observing the notice assembly 10, or the portion bearing no such graphic symbols can be paced at the viewing opening 28 when that portion of the assembly 10 is not in use. The notice assembly 10 also includes ink receptive means on the front surface 22 of the wall part 18 that includes graphic symbols 36, 37 and 38 providing incomplete information concerning one or more of a) the location of the person, b) the time of return for the person, c) the normal work hours for the person, and d) an alternate person to contact when the person is absent (e.g., Return; Location; Contactas illustrated). The ink receptive means affords application of indicia with quick drying ink from a quick drying ink applying implement or pen to complete the information (i.e., to designate the persons time of return, to designate the persons location, and/or to designate a person who can be contacted in the persons absence); and affords subsequent removal of the ink by wiping it away so that ink can again be applied to provide different information. In the notice assembly 10, the ink receptive means comprises a polymeric layer defining the front surface 22 of the wall part 18 and affording application of quick drying ink to form indicia completing the information, and subsequent wiping away of the ink from the front surface 22.

As illustrated, the support portion 12 including its base part 14, its vertical wall part 18, and its hollow tubular part 25 can comprise a unitary profile extrusion of a polymeric material such as non-weatherable polyvinyl chloride. Also, as illustrated, the base part can include a generally U-shaped channel 44 portion adapted to receive through its open ends and to store a pen (not illustrated) for applying the quick drying ink.

Figure 5:
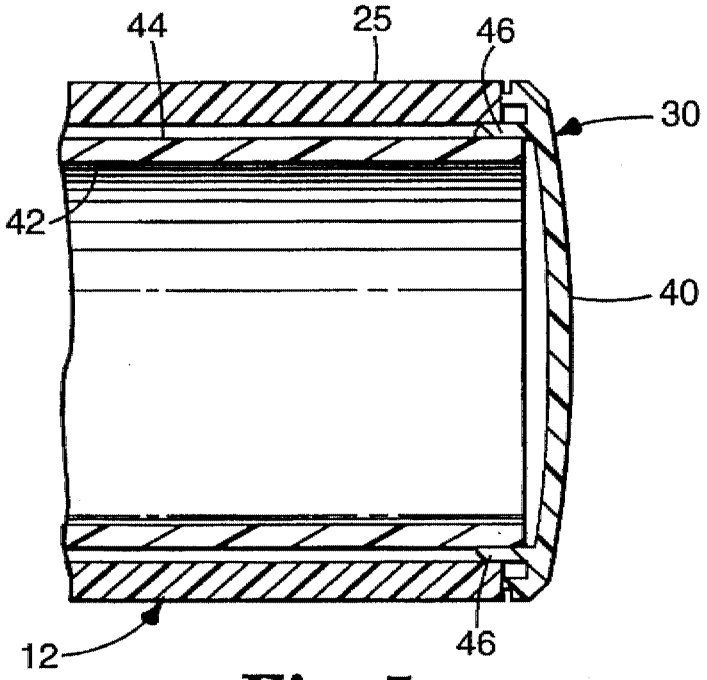
FIG. 5 is an enlarged fragmentary sectional view taken approximately along line 5—5 of FIG. 4.

The display member 30 comprises cylindrical flange portions 40 fixed at the axially spaced ends of the cylindrical portion 32 and mounted for rotation about the axis 26. The flange portions 40 project radially along axially spaced end surfaces of the tubular part 25, and are manually engageable to afford rotation of the display member 30 to position or display a desired one of sets of graphic symbols 34 on its peripheral surface at or across the viewing opening 28 of the tubular part 25. As is best seen in FIG. 5, the tubular part 25 includes a hollow cylindrical tube 42 (e.g., of cardboard) around which is adhered a sheet 44 (e.g., of paper) on which the graphic symbols 34 are printed. The opposite ends of the tube 42 and edge portions of the sheet 44 around it are received in recesses defining by the inner surfaces of projecting cylindrical bearing ridges 46 included in the flange portions 40. The outer surfaces of the bearing ridges 46 project short distances along the cylindrical inner surface of the tubular part 25 inwardly from its axially spaced end surfaces and provide bearing surfaces during rotation of the display member 30 within the tubular part 25. The bearing ridges 46 also space the outer surface of the sheet 44 from the inner surface of the tubular part 25 to prevent contact therebetween as the display member 30 is rotated.

Preferably, the quick drying ink is applied to the front surface 22 using an EXPO (™) Dry-Erase Marker commercially available from Sanford Corp, Bellwood, Ill., and the portion of the ink receptive means that provides the front surface 22 to which the quick drying ink is intended to be applied can be defined by a layer of transparent polyethylene terepthalate (P.E.T.) adhered by a layer of a suitable transparent adhesive to a white colored layer of styrene which in turn is adhered to by a layer of a suitable adhesive to the portion of the vertical wall part 18 provided by the unitary profile extrusion described above. The graphic symbols 36, 37 and 38 can be printed on either the layer of polyethylene terepthalate or on the layer of styrene.

A person who intends to be absent from their work area and who wishes to use the notice assembly 10 can select the most appropriate set of graphic symbols 34 on the display member 30, and place them at the opening 28 which can be done by manually engaging and rotating one of the flange portions 40 of the display member 30. In addition, or as an option to placing a set of graphic symbols 34 at the opening 28, that person can complete the information on the front surface 22 of the wall part 18 using quick drying ink applied with a pen. The user can then place the notice assembly 10 on a horizontal surface (such as the top surface 11 of a desk) while the user is gone to notify others of information concerning his or her absence. When the user returns, he or she can erase any indicia written on the front surface 22, and can rotate the display member 30 so that no meaningful graphics appear at the viewing opening 28, thus readying the notice assembly 10 for future use.

Referring now to FIG. 6 of the drawing there is illustrated a second embodiment of a notice assembly according to the present invention that is generally designated by the reference numeral 50. Parts of the notice assembly 50 that are similar to the parts of the notice assembly 10 are designated by the same reference numbers except for the addition of the suffix "a".

Generally, the notice assembly 50 comprises a support portion **12*a* including a base part 14*a* adapted to be supported on a horizontal surface, a vertical wall part 18*a* having opposite normally upper and lower opposite edges 19*a* and 20*a* with the lower edge 20*a* attached to the base part 14*a* and having a front outer surface 22*a* extending between the base part 14*a* and the upper edge 19*a*, and a hollow tubular or cylindrical part 25*a* having an axis and having an axially extending through slot or viewing opening 28*a*. The tubular part 25*a* is fixed along the upper edge 19*a* of the vertical wall 18*a* with its axis parallel to the upper edge 19*a* and the opening 28*a* adjacent the front surface of the wall part 18*a*. The base part 14*a* is adapted to support the wall part 18*a* and the tubular part 25*a* on a horizontal surface with the wall part 18*a* projecting generally vertically upwardly from the horizontal surface and the tubular part 25*a* uppermost. The notice assembly 50 also includes a display member 30a comprising a portion 32a mounted in the tubular part 25a for rotation about its axis 26a that has on its peripheral surface a plurality of axially extending circumferentially spaced sets of graphic symbols 34a providing information about the location of the person, and a portion that has no such information on it but which may bear decorative graphics. Any one of the sets of graphic symbols 34a is positionable at or across the viewing opening 28a of the tubular part 25a to afford viewing that set of graphic symbols by a person observing the notice assembly 50. The notice assembly 50 also includes graphic symbols 52, 53 and 54 on the front surface 22a of the wall part 18a that provide incomplete information about one or more of a) the location of the person, b) the time of return for the person, and c) an alternate person to contact when the person is absent; and ink receptive means affording application of indicia with quick drying ink from a quick drying ink applying implement to complete the information, and subsequent removal of the ink. In the notice assembly 50, the ink receptive means comprises a pad 56 of sheets or notes mounted on the front surface 22a, each of the sheets having front and rear major surfaces and a layer of pressure sensitive adhesive on the rear surface releasably attaching each of the sheets to the front surface of the adjacent sheet in the pad 56, the uppermost sheet in the pad 56 being adapted to be written on with quick drying ink to form indicia completing the information, and the uppermost sheet being removable to remove the ink. In the notice assembly 50, the graphic symbols 52, 53 and 54 included in the incomplete information are visible on the front surface 22a of the wall part 18a adjacent the pad 56** of notes.

The notice assembly 50 is used in generally the same way as the notice assembly 10, except that graphics to provide the incomplete information are written on the top sheet on the pad 56 of sheets, and after the user returns, that top sheet is removed and disposed of.

Referring now to FIG. 7 of the drawing there is illustrated a second embodiment of a notice assembly according to the present invention that is generally designated by the reference numeral 60. Parts of the notice assembly 60 that are similar to the parts of the notice assembly 10 are designated by the same reference numbers except for the addition of the suffix "b".

Generally, the notice assembly 60 comprises a support portion 12b including a base part 14b adapted to be supported on a horizontal surface, a vertical wall part 18b having opposite normally upper and lower opposite edges 19b and 20b with the lower edge 20b attached to the base part 14b and having a front outer surface 22b extending between the base part 14b and the upper edge 19b, and a hollow tubular or cylindrical part 25b having an axis and having an axially extending through slot or viewing opening 28b. The tubular part 25b is fixed along the upper edge 19b of the vertical wall 18b with its axis parallel to the upper edge 19b and the opening 28b adjacent the front surface of the wall part 18b. The base part 14b is adapted to support the wall part 18b and the tubular part 25b on a horizontal surface with the wall part 18b projecting generally vertically upwardly from the horizontal surface and the tubular part 25b uppermost. The notice assembly 60 also includes a display member 30b comprising a portion 32b mounted in the tubular part 25b for rotation about its axis 26b that has on its peripheral surface a plurality of axially extending circumferentially spaced sets of graphic symbols 34b providing information about the location of the person, and a portion that has no such information on it but which may bear decorative graphics. Any one of the sets of graphic symbols 34b is positionable at or across the viewing opening 28b of the tubular part 25b to afford viewing that set of graphic symbols 34b by a person observing the notice assembly 60. The notice assembly 60 also includes graphic symbols 62, 63 and 64 on the front surface 22b of the wall part 18b that providing incomplete information about one or more of a) the location of the person, b) the time of return for the person, and c) an alternate person to contact when the person is absent; and ink receptive means affording application of indicia with quick drying ink from a quick drying ink applying implement to complete the information, and subsequent removal of the ink. In the notice assembly 60, the ink receptive means comprises a pad 66 of sheets or notes mounted on the front surface 22b, each of the sheets having front and rear major surfaces and a layer of pressure sensitive adhesive on the rear surface releasably attaching each of the sheets to the front surface of the adjacent sheet in the pad 66, the uppermost sheet in the pad 66 being adapted to be written on with quick drying ink to form indicia completing the information, and the uppermost sheet being removable to remove the ink. In the notice assembly 60, the graphic symbols 62, 63 and 64 included in the incomplete information are pre-printed on each of the sheets forming the pad 66 of notes.

Preferably, either of the pads 56 or 66 of notes or sheets is of the type commercially available from Minnesota Mining and Manufacturing Company, St. Paul, Minn., under the trade designation Post-it (™) brand notes, which notes are attached together in the pad with layers of repositionable pressure sensitive adhesive.

The present invention has now been described with reference to three embodiments. It will be apparent to those skilled in the art that many changes can be made in the embodiments described without departing from the scope of the present invention. For example, instead of the base part providing means for supporting the support portion of the notice assembly, the base part can be deleted, or can be made in a shape that includes the pen receiving generally U-shaped channel 44 portion but will not support the notice assembly on a horizontal surface such as by removing the portion thereof that projects beyond the point indicated by the lead line on the reference numeral 80 in FIG. 2; and the means for supporting the support portion of the notice assembly can be provided by an attachment device for attaching the support portion to a wall which could be attached along the side of the tubular part 25 opposite the viewing opening 28. Thus, the scope of the present invention should not be limited to the structures described in this application, but only by the structure described by the language of the claims and the equivalents thereof.

We claim:

1. A notice assembly for use at a predetermined location to notify others of information concerning a person when the person is absent from the location, said notice assembly comprising:

a support portion comprising a vertical wall part having opposite normally upper and lower opposite edges and having a major front surface extending between said upper and lower edges, and a hollow tubular part having an axis and having an axially extending through viewing opening, said tubular part being fixed along the upper edge of said vertical wall part with said axis parallel to said upper edge and said viewing opening facing in the same direction as the front surface of said vertical wall part, means adapted for supporting said wall part and said tubular part on a surface with said wall part projecting generally vertically upwardly and with said tubular part uppermost;

a display member comprising a portion mounted for rotation about said axis in said tubular part, said portion of said display member having a peripheral surface bearing a plurality of axially extending circumferentially spaced sets of graphic symbols providing information about the location of the person, each of said sets of graphic symbols being positionable at the viewing opening of said tubular part to afford viewing thereof, graphic symbols visible on said front surface of said wall part that provide incomplete information about one or more of a) the location of the person, b) the time of return for the person, c) the normal work hours for the person, and c) an alternate person to contact when the person is absent; and ink receptive means on said front surface for affording application of indicia to said assembly using quick drying ink from a quick drying ink applying implement to complete said information and for affording subsequent removal of the ink.

2. A notice assembly according to claim 1 wherein said ink receptive means comprises a polymeric layer defining said front surface and affording application of quick drying ink on said polymeric layer to form indicia completing said information, and subsequent wiping away of the ink from said polymeric layer.

3. A notice assembly according to claim 1 wherein said ink receptive means comprises a pad of notes mounted on said front surface, each of said notes having front and rear major surfaces and a layer of pressure sensitive adhesive on said rear surface releasably attaching each of said notes to the front surface of the adjacent note in the pad, said uppermost note in the pad being adapted to be written on with quick drying ink to form indicia completing said information, and said uppermost note being removable to remove the ink.

4. A notice assembly according to claim 3 wherein a portion of said incomplete information is visible on said front surface of said wall part adjacent said pad of notes.

5. A notice assembly according to claim 3 wherein said incomplete information is on each of said sheets forming said pad of notes.

6. A notice assembly according to claim 1 wherein said support portion, including said vertical wall part and said hollow tubular part, comprises a unitary extrusion.

7. A notice assembly according to claim 1 wherein said tubular part has axially spaced end surfaces, said portion mounted for rotation about said axis in said tubular part has spaced ends, and said display member comprises flange portions fixed at said spaced ends of said portion mounted for rotation about said axis and projecting radially along said axially spaced end surfaces of said tubular part, said flange portions being manually engageable to afford rotation of said display member to display a desired one of sets of graphic symbols in said opening of said tubular part.

8. A notice assembly according to claim 7 wherein said portion mounted for rotation about said axis in said tubular part comprises a hollow tube having an inner surface, a cylindrical periphery, and axially spaced ends, and a sheet on which are printed said graphic symbols wrapped around the cylindrical periphery of said hollow tube; and said flange portions include cylindrical bearing ridges having inner surfaces in which are received and fixed portions of the tube and sheet adjacent said ends of the tube, said cylindrical bearing ridges having outer surfaces disposed along the inner surface of said tubular part and providing beating surfaces during rotation of said display member, said bearing ridges spacing the sheet from the inner surface of the tubular part to prevent contact therebetween as the display member is rotated.

9. A notice assembly according to claim 7 wherein said tubular part, said portion mounted for rotation about said axis in said tubular part, and said flange portions are all generally cylindrical.

10. A notice assembly according to claim 1 wherein said support portion further comprises a base part adapted to be supported on a horizontal surface with said lower edge of said vertical wall part being attached to the base part, said base part providing said means adapted for supporting said wall part and said tubular part.

11. A notice assembly according to claim 10 wherein said base part includes a generally U-shaped channel adapted to receive a pen for applying quick drying ink.

12. A notice assembly according to claim 1 wherein said support portion further comprises a base part with said lower edge of said vertical wall part being attached to the base part, said base part including a generally U-shaped channel adapted to receive a pen for applying quick drying ink.

* * * * *